US011393488B2

(12) United States Patent
Zhang et al.

(10) Patent No.: US 11,393,488 B2
(45) Date of Patent: Jul. 19, 2022

(54) SYSTEMS AND METHODS FOR ENHANCING AUDIO SIGNALS

(71) Applicant: BEIJING DIDI INFINITY TECHNOLOGY AND DEVELOPMENT CO., LTD., Beijing (CN)

(72) Inventors: Yi Zhang, Beijing (CN); Hui Song, Beijing (CN); Chengyun Deng, Beijing (CN); Yongtao Sha, Beijing (CN)

(73) Assignee: BEIJING DIDI INFINITY TECHNOLOGY AND DEVELOPMENT CO., LTD., Beijing (CN)

( * ) Notice: Subject to any disclaimer, the term of this patent is extended or adjusted under 35 U.S.C. 154(b) by 139 days.

(21) Appl. No.: 16/857,679

(22) Filed: Apr. 24, 2020

(65) Prior Publication Data

US 2020/0342889 A1 Oct. 29, 2020

(30) Foreign Application Priority Data

Apr. 26, 2019 (CN) ..... 201910344914.2

(51) Int. Cl.
*G10L 21/0232* (2013.01)
*G10L 19/008* (2013.01)
*G10L 21/0224* (2013.01)

(52) U.S. Cl.
CPC ..... *G10L 21/0232* (2013.01); *G10L 19/008* (2013.01); *G10L 21/0224* (2013.01)

(58) Field of Classification Search
CPC ..... G10L 21/0232; G10L 21/0224; G10L 19/008
See application file for complete search history.

(56) References Cited

U.S. PATENT DOCUMENTS 10,373,628 B2 * 8/2019 Taniguchi ..... H04R 1/406

OTHER PUBLICATIONS

Nikunen et al., "Source Separation and Reconstruction of Spatial Audio Using Spectrogram Factorization," in Parametric Time-Frequency Domain Spatial Audio , IEEE, 2018, pp. 215-250, doi: 10.1002/9781119252634.ch9. (Year: 2018).*

(Continued)

*Primary Examiner* — Michelle M Koeth
(74) *Attorney, Agent, or Firm* — Bayes PLLC

(57) ABSTRACT

Embodiments of the disclosure provide systems and methods for enhancing audio signals. The system may include a communication interface configured to receive multi-channel audio signals acquired from a common signal source. The system may further include at least one processor. The at least one processor may be configured to separate the multi-channel audio signals into a first audio signal and a second audio signal in a time domain. The at least one processor may be further configured to decompose the first audio signal and the second audio signal in a frequency domain to obtain a first decomposition data and a second decomposition data, respectively. The at least one processor may be also configured to estimate a noise component in the frequency domain based on the first decomposition data and the second decomposition data. The at least one processor may be additionally configured to enhance the first audio signal based on the estimated noise component. The system may also include a speaker configured to output the enhanced first audio signal.

20 Claims, 6 Drawing Sheets

(56) References Cited

OTHER PUBLICATIONS

Carabias-Orti et al., "Multichannel Blind Sound Source Separation Using Spatial Covariance Model With Level and Time Differences and Nonnegative Matrix Factorization," in IEEE/ACM Transactions on Audio, Speech, and Lang. Proc., vol. 26, No. 9, pp. 1512-1527, Sep. 2018 (Year: 2018).*

Byun et al., "Initialization for NMF-based audio source separation using priors on encoding vectors," in China Communications, vol. 16, No. 9, pp. 177-186, Sep. 2019, doi: 10.23919/JCC.2019.09.013. (Year: 2019).*

Fan et al., "Speech enhancement using segmental nonnegative matrix factorization," 2014 IEEE International Conference on Acoustics, Speech and Signal Processing (ICASSP), 2014, pp. 4483-4487, doi: 10.1109/ICASSP.2014.6854450. (Year: 2014).*

* cited by examiner

200

SYSTEMS AND METHODS FOR ENHANCING AUDIO SIGNALS

CROSS REFERENCE TO RELATED APPLICATION

The present application is based on and claims the benefits of priority to Chinese Application No. 201910344914.2, filed Apr. 26, 2019, the entire content of which is incorporated herein by reference.

TECHNICAL FIELD

The present disclosure relates to systems and methods for audio signal processing, and more particularly to, systems and methods for enhancing an audio signal by reconfiguring audio signals separated from the audio signal.

BACKGROUND

Speech recognition technologies have been applied to many areas recently. Compared to the earlier applications for speech recognition such as automated telephone systems and medical dictation software, recent applications of speech recognition changed the way people interact with their devices, homes, and cars.

To obtain a satisfied speech recognition result, it is essential to have a high-quality audio signal as an input of a speech recognition system. However, in real-world, an acquired audio signal is usually a mixture of signals from multiple audio sources. For example, a speech recognition system may receive a mixed audio signal including a human speech and environmental noises. The speech signal can come from a point audio source and the noises can come from diffuse sound sources, e.g., natural sources such as echo, wind sound, waves, and other unnatural sound sources. In order to enhance the quality of the audio signal, separation of the speech signal from the noises is desirable.

BSS is a technique for separating specific sources from sound mixture without prior information, e.g., signal statistics, source location, etc. For example, independent component analysis (ICA) is one of the most commonly used BSS method. On the other hand, Nonnegative Matrix Factorization (NMF) is a popular dimension-reduction technique, employed for non-subtractive, part-based representation of non-negative data, i.e., speech magnitude or power spectrum. In particular, multi-channel nonnegative matrix factorization (MNMF) is developed to use the spatial covariance to model the mixing conditions of the recoding environment. Furthermore, post process is often deployed after multi-channels speech enhancement to further reduce the interference. Some conventional post processing methods includes the single-channel based methods and adaptive filter based methods.

However, while these conventional separation and post processing methods yield good performance in point source separation, they are often insufficient to suppress diffuse interferences. Techniques to enhance audio signals from diffuse sources need to be improved. Reducing diffuse noises in an audio signal and improving speech perceptual can greatly increase the accuracy of speech recognition results.

Embodiments of the disclosure address the above problems by methods and systems for enhancing audio signals.

SUMMARY

Embodiments of the disclosure provide a system for enhancing audio signals. The system may include a communication interface configured to receive multi-channel audio signals acquired from a common signal source. The system may further include at least one processor. The at least one processor may be configured to separate the multi-channel audio signals into a first audio signal and a second audio signal in a time domain. The at least one processor may be further configured to decompose the first audio signal and the second audio signal in a frequency domain to obtain a first decomposition data and a second decomposition data, respectively. The at least one processor may be also configured to estimate a noise component in the frequency domain based on the first decomposition data and the second decomposition data. The at least one processor may be additionally configured to enhance the first audio signal based on the estimated noise component. The system may also include a speaker configured to output the enhanced first audio signal.

Embodiments of the disclosure also provide a method for enhancing audio signals. The method may include receiving, by a communication interface, multi-channel audio signals acquired from a common signal source. The method may further include separating, by at least one processor, the multi-channel audio signals into a first audio signal and a second audio signal originated in a time domain. The method may also include decomposing, by the at least one processor, the first audio signal and the second audio signal in a frequency domain to obtain a first decomposition data and a second decomposition data, respectively. The method may additionally include estimating, by the at least one processor, a noise component in the frequency domain based on the first decomposition data and the second decomposition data. The method may also include enhancing, by the at least one processor, the first audio signal based on the estimated noise component.

Embodiments of the disclosure further provide a non-transitory computer-readable medium having instructions stored thereon that, when executed by one or more processors, causes the one or more processors to perform a method for enhancing audio signals. The method may include receiving multi-channel audio signals acquired from a common signal source. The method may further include separating the multi-channel audio signals into a first audio signal and a second audio signal originated in a time domain. The method may also include decomposing the first audio signal and the second audio signal in a frequency domain to obtain a first decomposition data and a second decomposition data, respectively. The method may additionally include estimating a noise component in the frequency domain based on the first decomposition data and the second decomposition data. The method may also include enhancing the first audio signal based on the estimated noise component.

It is to be understood that both the foregoing general description and the following detailed description are exemplary and explanatory only and are not restrictive of the invention, as claimed.

DETAILED DESCRIPTION

Reference will now be made in detail to the exemplary embodiments, examples of which are illustrated in the accompanying drawings. Wherever possible, the same reference numbers will be used throughout the drawings to refer to the same or like parts.

In some embodiments, an audio processing system and method is disclosed to reduce interference after multi-channel speech enhancement (MSE) algorithms, including but not limited to MNMF. For example, MNMF may be performed to separate the inputs into separated speech and interference channels. Speech and interference basis matrices are obtained from the corresponding channels. First, speech component is removed from interference bases, in order to prevent speech distortion. Then interference bases are used to reconstruct the MNMF separated speech spectra under multiplicative update (MU) rules, where only activation matrix is updated. Since interference bases exclude speech component, large distance between the reconstructed and the original speech spectra should exist in the region where speech energy is concentrated, like harmonics, or unvoiced speech.

Figure 1A:
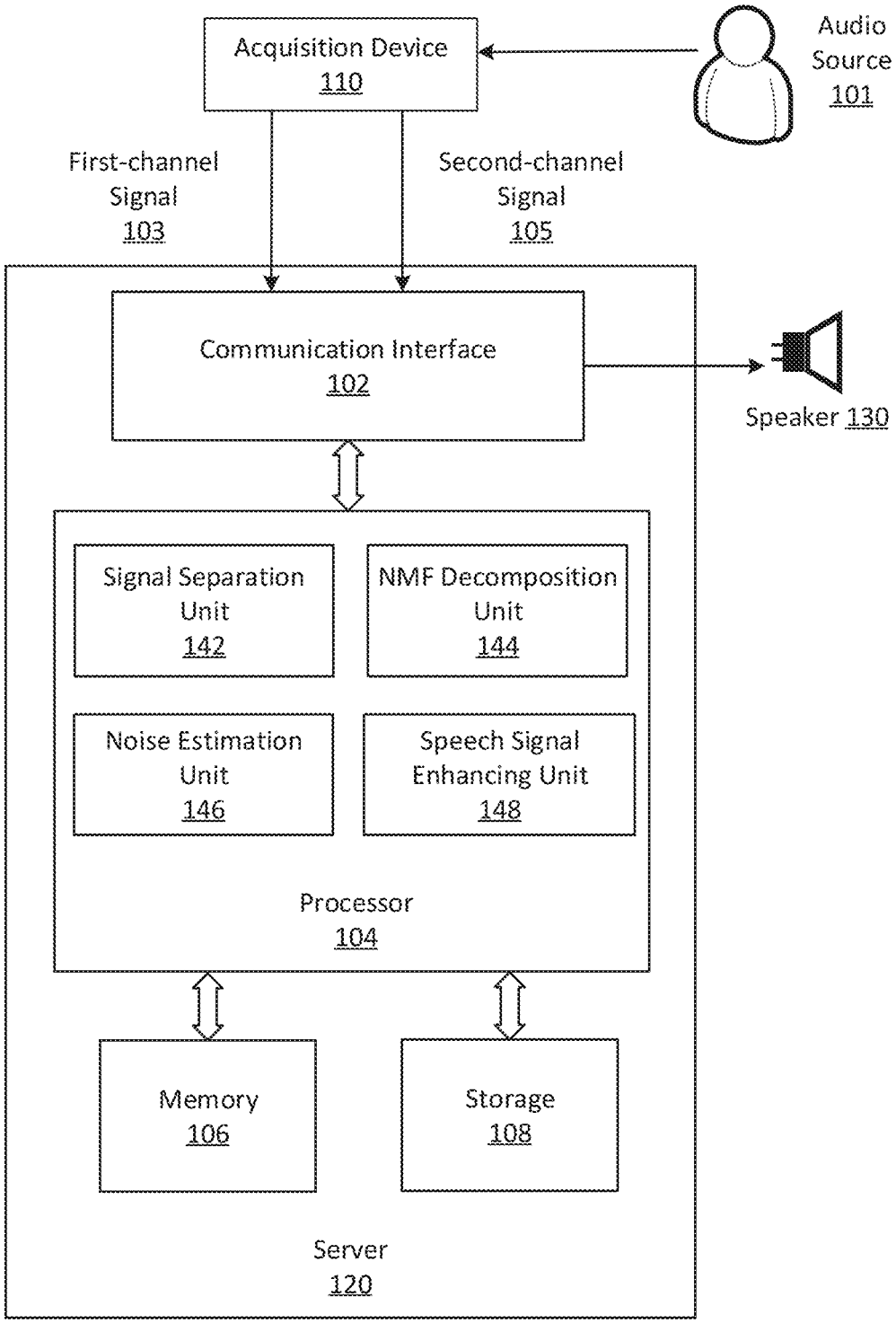
FIG. 1A illustrates a block diagram of an exemplary system for reducing noise in an audio signal, according to embodiments of the disclosure.
Figure 1B:
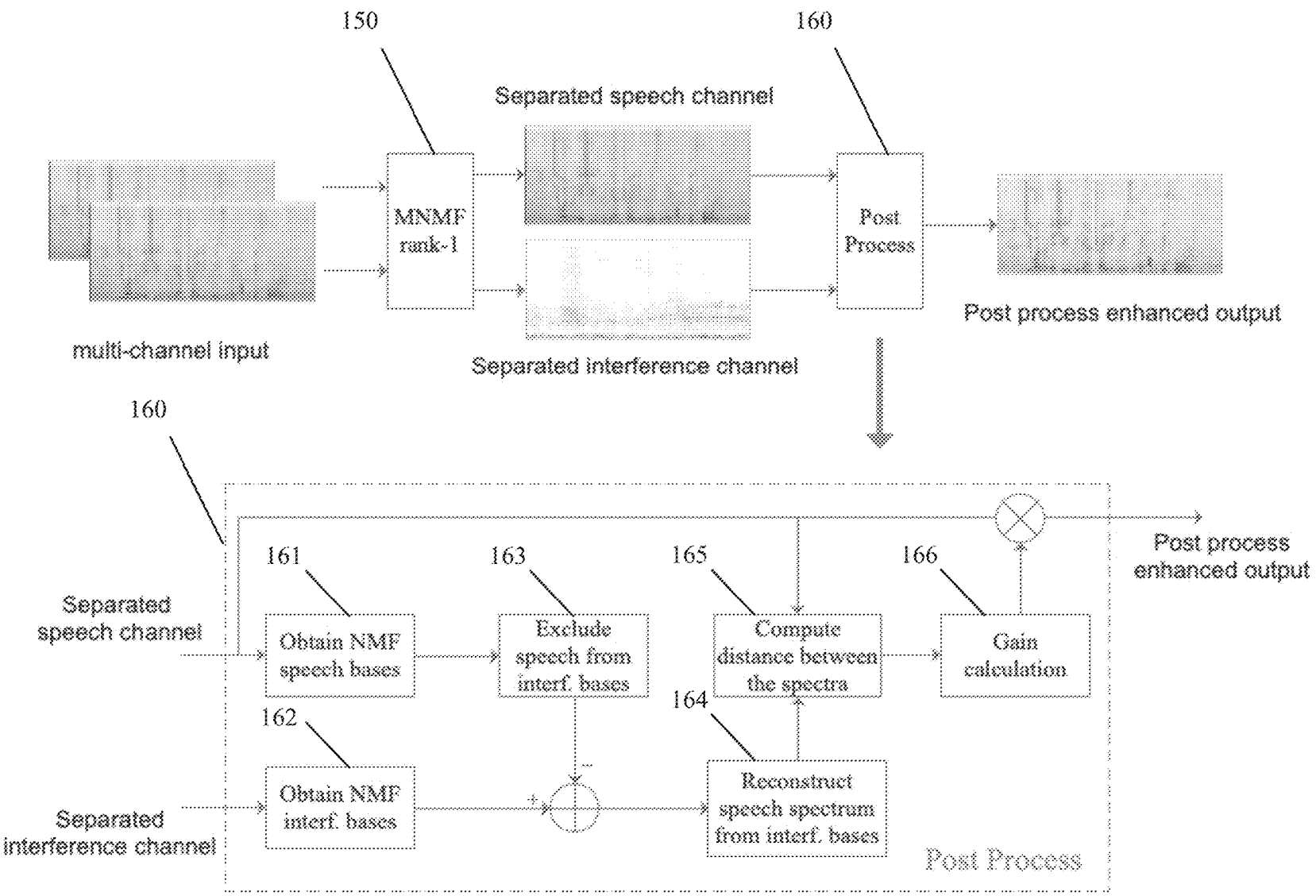
FIG. 1B illustrates a data flow diagram for reducing noise in an audio signal compatible with the embodiment of FIG. 1A, according to embodiments of the disclosure.

FIG. 1A illustrates a block diagram of an exemplary system for reducing noise in an audio signal, according to embodiments of the disclosure. FIG. 1B illustrates a data flow diagram for reducing noise in an audio signal compatible with the embodiment of FIG. 1A, according to embodiments of the disclosure. FIG. 1A and FIG. 1B will be described together.

Consistent with the present disclosure, acquisition device 110 may acquire audio signals from audio source 101. In some embodiments, audio source 101 may be a person who gives a speech in a noisy environment, a speaker that plays a speech, an audio book, a news broadcast, or a song in the noisy environment, etc. In some embodiments, acquisition device 110 may be a microphone device, a sound recorder, or the like. In some embodiments, acquisition device 110 may be a standalone audio receiving device or part of another device, such as a mobile phone, a wearable device, a headphone, a vehicle, a surveillance system, etc.

In some embodiments, acquisition device 110 may be configured to receive multi-channel signals, including, e.g., a first-channel signal 103 of a first channel and a second-channel signal 105 of a second channel. For example, acquisition device 110 may include two or more acquisition channels, or include two or more individual acquisition units. In some embodiments, audio signal of each channel includes a human speech and diffuse noises. Server 120 may receive the multi-channel audio signals from acquisition device 110, and then reduce noises from the audio signal and enhance its quality. Server 120 may transform and decompose the two audio signals to obtain an enhanced speech signal based on an estimated noise component.

In some embodiments, as shown in FIG. 1A, server 120 may include a communication interface 102, a processor 104, a memory 106, and a storage 108. In some embodiments, server 120 may have different modules in a single device, such as an integrated circuit (IC) chip (implemented as an application-specific integrated circuit (ASIC) or a field-programmable gate array (FPGA)), or separate devices with dedicated functions. In some embodiments, one or more components of server 120 may be located in a cloud, or may be alternatively in a single location or distributed locations. Components of server 120 may be in an integrated device, or distributed at different locations but communicate with each other through a network (not shown).

Communication interface 102 may send data to and receive data from components such as speaker 130 and acquisition device 110 via communication cables, a Wireless Local Area Network (WLAN), a Wide Area Network (WAN), wireless networks such as radio waves, a cellular network, and/or a local or short-range wireless network (e.g., Bluetooth™), or other communication methods. In some embodiments, communication interface 102 can be an integrated services digital network (ISDN) card, cable modem, satellite modem, or a modem to provide a data communication connection. As another example, communication interface 102 can be a local area network (LAN) card to provide a data communication connection to a compatible LAN. Wireless links can also be implemented by communication interface 102. In such an implementation, communication interface 102 can send and receive electrical, electromagnetic or optical signals that carry digital data streams representing various types of information via a network.

Consistent with some embodiments, communication interface 102 may receive multi-channel audio data such as first-channel signal 103 and second-channel signal 105 of two channels acquired by acquisition device 110.

Communication interface 102 may further provide the received data to storage 108 for storage or to processor 104 for processing. Communication interface 102 may also receive an enhanced audio signal generated by processor 104, and provide the enhanced audio signal to a local speaker or any remote speaker (e.g., speaker 130) via a network.

Processor 104 may include any appropriate type of general-purpose or special-purpose microprocessor, digital signal processor, or microcontroller. Processor 104 may be configured as a separate processor module dedicated to enhancing audio signals. Alternatively, processor 104 may be configured as a shared processor module for performing other functions unrelated to audio signal enhancement.

As shown in FIG. 1A, processor 104 may include multiple modules, such as a signal separation unit 142, an NMF decomposition unit 144, a noise estimation unit 146, and a speech signal enhancing unit 148, and the like. These modules (and any corresponding sub-modules or sub-units) can be hardware units (e.g., portions of an integrated circuit) of processor 104 designed for use with other components or software units implemented by processor 104 through executing at least part of a program. The program may be stored on a computer-readable medium, and when executed by processor 104, it may perform one or more functions. Although FIG. 1A shows units 142-148 all within one processor 104, it is contemplated that these units may be distributed among multiple processors located near or remotely with each other.

Consistent with some embodiments, signal separation unit 142 may be configured to separate the multi-channel audio signals (e.g., first-channel signal 103 and second-channel signal 105) into a first audio signal and a second audio signal. In some embodiments, a blind source separation (BSS) method may be performed for separating the speech and interference channel signals. Blind source separation is a technique for separating specific sources from sound mixture without prior information, e.g., signal statistics, source location, etc.

In some embodiments, a multi-channel nonnegative matrix factorization (MNMF) algorithm is employed for the blind source separation. MNMF utilizes a spatial covariance to model a mixing condition of a recoding environment. Under an assumption of instantaneous mixing in the frequency domain, MNMF with rank-1 can be implemented for the separation tasks. For example, as shown in FIG. 1B, signal separation unit 142 may implement MNMF rank-1 module 150 to separate the multi-channel input into a separated speech channel (an example of the first audio signal) and a separated interference channel (an example of the second audio signal).

By utilizing information between channels, MNMF clusters the decomposed bases into specific sources in a blind situation. In some embodiments, using the rank-1 MNMF algorithm, most speech component goes to the separated speech channel. However, there is no complete separation between speech and noise. In particular, rank-1 MNMF suppresses little interference in the separated speech channel and some speech component may leak into the separated interference channel. As a result, the speech channel signal may consist mainly of the speech signal but also include some noises, while the interference channel signal may consist largely of noises but include a small amount of speech signal. That is, in general, the speech signal ratio of the speech channel signal is higher than the speech signal ratio of the interference channel signal. Consistent with some embodiments, a first speech signal ratio of the speech channel signal is higher than a first threshold and a second speech signal ratio of the interference channel signal is lower than a second threshold, and the second threshold is smaller than the first threshold. It is contemplated that other blind source separation methods may also be used to separate the multi-channel audio signals to achieve the same or similar separation results.

In some embodiments, the remaining units of processor 104, including NMF decomposition unit 144, noise estimation unit 146 and signal enhancing unit 148, may implement postprocessing module 160 of FIG. 1B, which includes sub-modules 161-166. Consistent with some embodiments, NMF decomposition unit 144 may be configured to Fourier transform the first audio signal (e.g., the speech channel signal in FIG. 1B) and the second audio signal (e.g., the interference channel signal in FIG. 1B) into a frequency domain. The two Fourier transforms can perform in parallel.

NMF decomposition unit 144 may be further configured to decompose each Fourier-transformed audio signal using NMF to obtain an NMF basis matrix and an activation matrix. NMF algorithm is a dimension-reduction technique and aims to factorize a nonnegative matrix $X \in R^{I \times J}$, into a product of two nonnegative matrices, $X \approx TV$, where $T \in R^{I \times b}$ are several spectral bases and $V \in R^{b \times J}$ are temporal activations, where I and J denote the numbers of frequency bins and time frames, respectively, and b is the number of basis vectors. Typically, b (I+J)<I×J. $T \in R^{I \times b}$ and $V \in R^{b \times J}$ minimize some divergence metric, d(X, TV).

Consistent with some embodiments, each basis matrix T may consist of a speech basis matrix $T_s$ and a noise basis matrix $T_n$, i.e., $T=[T_s\ T_n]$, while the corresponding activation matrix $V=[V_s V_n]'$ with ' denoting matrix transpose. In a training stage, $T_s$ and $T_n$ can be trained separately with clean speech and noise data, respectively. At the speech enhancement stage, the basis matrix may be fixed and only activation matrix is updated. In some embodiments, once the algorithm converges, an optimal spectral gain G, i.e., Wiener gain, may be determined based on the speech and noise estimates derived from the NMF analysis, e.g., according to equation (1).

$$G = \frac{|\hat{S}|}{|\hat{S}| + |\hat{N}|} = \frac{T_s V_s}{T_s V_s + T_n V_n} \tag{1}$$

In some embodiments, basis and activation matrices may be updated in a MU procedure according to some cost functions. For example, three special instances of β-divergence may be applied as metrics in MU rules, e.g., Euclidean distance (β=2), Kullback-Leibler (KL) divergence (β=1), and Itakura-Saito (IS) divergence (β=0). In some embodiments, MU rules update basis matrix T and activation matrix V alternatively according to equations (2) and (3).

$$T \leftarrow T \frac{V'((TV)^{\beta-2}X)}{V'(TV)^{\beta-1}} \tag{2}$$

$$V \leftarrow V \frac{((TV)^{\beta-2}X)T'}{(TV)^{\beta-1}T'} \tag{3}$$

For example, as shown in FIG. 1B, NMF decomposition unit 144 may implement module 161 to obtain the NMF speech bases of the separated speech channel signal and implement module 162 to obtain the NMF interference bases of the separated interference channel signal. In some embodiments, if rank-1 MNMF is implemented to separate the multi-channel audio signals as shown in FIG. 1B, the NMF decomposition does not need to be performed again, but rather can be copied from the MU procedure in rank-1 MNMF.

Noise estimation unit 146 may be configured to obtain a modified NMF interference bases in a frequency domain based on the first decomposition data (e.g., the NMF speech bases) and the second decomposition data (e.g., the NMF interference bases). In some embodiments, a third NMF basis matrix corresponding to a noise signal is generated based on a first NMF basis matrix and a second NMF basis matrix.

Generally, basis matrix represents the frequency structure of the signal (e.g., harmonics of speech). In the separated speech channel, it is expected that speech related basis has larger value. Frequency sub-bands are labeled as speech if those speech related basis exceeds some pre-defined thresholds. Accordingly, elements of the first NMF basis matrix exceeding a third threshold are considered attributable to a speech component.

The corresponding elements of the second NMF basis matrix are then substituted with a predetermined value. The overwritten second NMF basis matrix is saved as a third NMF basis matrix. In some embodiments, in the separated interference channel, NMF basis matrix within the frequency sub-bins labeled above can be set to zero. For example, as shown in FIG. 1B, noise estimation module 146 may implement module 163 to exclude speech from the interference bases. By doing so, speech component is eliminated from interference basis matrix, and thus speech harmonics and strong unvoiced speech can be preserved. In some embodiments, a noise component in a frequency domain is obtained by using the third NMF basis matrix.

Noise estimation unit 146 may be further configured to obtain an estimated noise component (e.g., the reconstructed speech spectrum). In some embodiments, the third NMF basis matrix may be used to reconstruct the first audio signal, by implementing, e.g., module 164 in FIG. 1B. For example, the modified interference basis matrix (an example of the third NMF basis matrix) is utilized to reconstruct the separated speech spectrum, similar to regular NMF speech enhancing stage. The basis matrix is fixed and only activation matrix is updated. By using the distortion-free speech bases obtained from module 163, interference magnitude spectrum in the separated speech channel can be estimated.

In some embodiments, speech signal enhancing unit 148 may be configured to calculate the Euclidean distances between elements of a Fourier-transformed first audio signal and the corresponding elements of an estimated noise component in a frequency domain. For example, speech signal enhancing unit 148 may implement a module 165 of FIG. 1B to calculate the distances between the spectra. In some embodiments, the Euler distance between the reconstructed and speech spectrum is calculated. A large distance may be expected at the speech harmonics and unvoiced speech zone, since interference bases exclude speech information. In some embodiments, distance is calculated on each time-frequency (T-F) bin and then normalized along frequency scales.

In some embodiments, speech signal enhancing unit 148 may be further configured to adjust the elements of the Fourier-transformed first audio signal by gains determined based on the respective Euclidean distances. For example, speech signal enhancing unit 148 may implement a module 166 of FIG. 1B to calculate the gains. In some embodiments, a sigmoid-like activation function is used to convert the distance into the gain ranged in [0, 1]. For example, a modified version of sigmoid function described by equations (5) and (6) can be used. In the following equations, $X_{i,j}$ denotes the separated speech spectrum, $\hat{X}_{i,j}$ denotes the reconstructed speech spectrum, $d_{i,j}$ denotes the distance at T-F bin (i,j), and $\|\|$ denotes Euclidean norm.

$$d_{i,j}=|X_{i,j}-\hat{X}_{i,j}| \tag{5}$$

$$d_{i,j}=d_{i,j}/\|d_{i,j}\| \tag{6}$$

In some embodiments, speech signal enhancing unit 148 may inverse Fourier transform on the adjusted Fourier-transformed first audio signal to obtain an enhanced audio signal in a time domain.

Memory 106 and storage 108 may include any appropriate type of mass storage provided to store any type of information that processor 104 may need to operate. Memory 106 and storage 108 may be a volatile or non-volatile, magnetic, semiconductor, tape, optical, removable, non-removable, or other type of storage device or tangible (i.e., non-transitory) computer-readable medium including, but not limited to, a ROM, a flash memory, a dynamic RAM, and a static RAM. Memory 106 and/or storage 108 may be configured to store one or more computer programs that may be executed by processor 104 to perform noise reducing and audio signal enhancing functions disclosed herein. For example, memory 106 and/or storage 108 may be configured to store program(s) that may be executed by processor 104 to enhance an audio signal acquired from an audio source.

Memory 106 and/or storage 108 may be further configured to store information and data used by processor 104. For instance, memory 106 and/or storage 108 may be configured to store the various types of data (e.g., audio signals, metadata, etc.) acquired by acquisition device 110. Memory 106 and/or storage 108 may also store intermediate data such as machine learning models, thresholds, and parameters, etc. The various types of data may be stored permanently, removed periodically, or disregarded immediately after each audio signal is processed.

Speaker 130 may be configured to output an enhanced audio signal received from communication interface 102. Speaker 130 may connect to a speech recognition system as an audio input device. In some embodiments, speaker 130 may be a standalone audio display/output device or part of another device, such as a mobile phone, a wearable device, a headphone, a vehicle, a surveillance system, etc.

Figure 2:
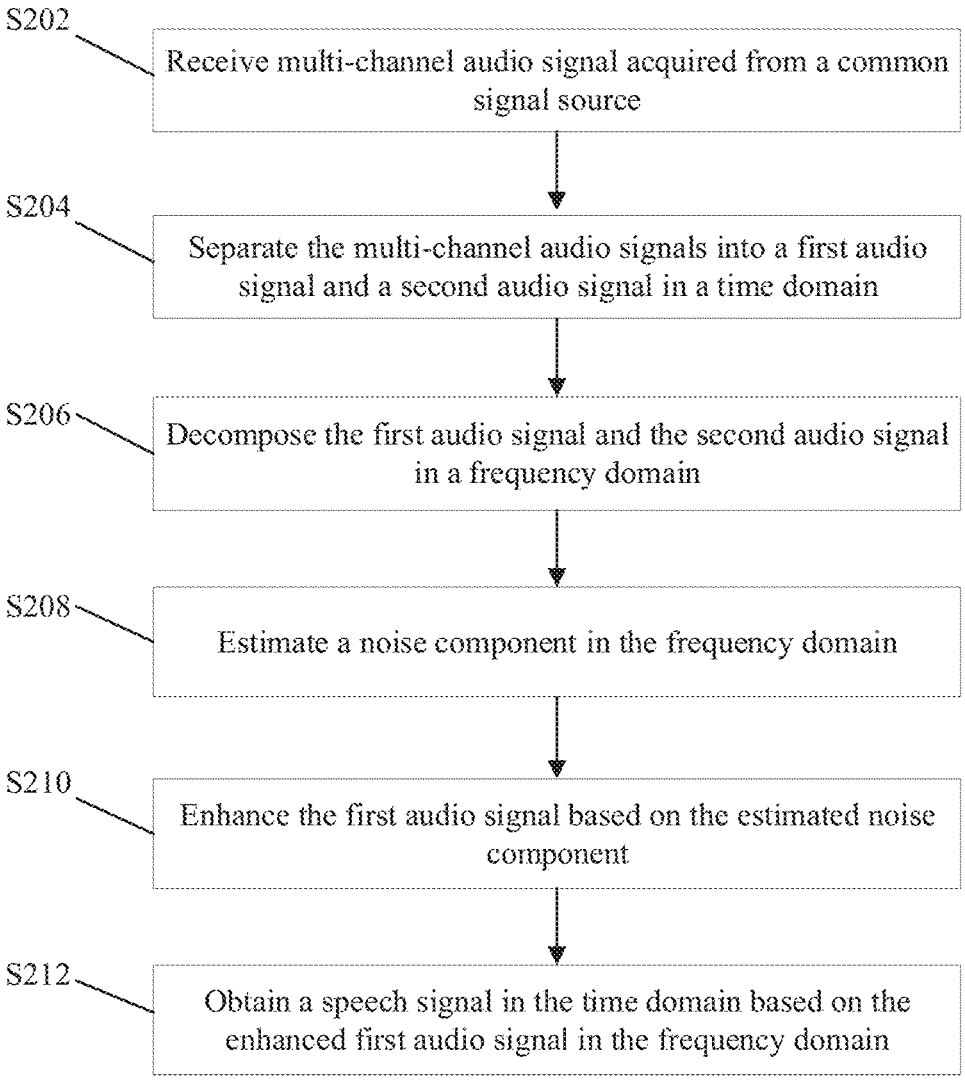
FIG. 2 illustrates a flowchart of an exemplary method for reducing noise in an audio signal, according to embodiments of the disclosure.

FIG. 2 illustrates a flowchart of an exemplary method 200 for reducing noise in an audio signal, according to embodiments of the disclosure. In some embodiments, method 200 may be implemented by an audio signal enhancement system that includes, among other things, server 120, acquisition device 110, and speaker 130. However, method 200 is not limited to that exemplary embodiment. Method 200 may include steps S202-S212 as described below. It is to be appreciated that some of the steps may be optional to perform the disclosure provided herein. Further, some of the steps may be performed simultaneously, or in a different order than shown in FIG. 2.

In step S202, a multi-channel audio signal is received from acquisition device 110. In some embodiments, acquisition device 110 may include at least two acquisition channels, or include at least two individual acquisition units, to acquire multi-channel audio signals, such as first-channel signal 103 and second-channel signal 105. For example, a speech may be acquired by acquisition device 110 in a noisy stadium environment through different microphones. In some embodiments, both channel signals 103 and 105 are mixtures of speech signals and environmental noise signals. The audio information acquired through multiple channels can be later utilized for a blind source separation. Acquisition device 110 sends a first-channel signal 103 and a second-channel signal 105 to communication interface 102.

In step S204, processor 104 uses a blind source separation method to separate the multi-channel audio signals acquired from audio source 101. In some embodiments, multi-channel NMF(MNMF) which is a natural extension of simple NMF method for multi-channel signals may be used to separate the multi-channel audio signals. By utilizing information between channels (e.g., the first-channel audio signal 103 and the second-channel audio signal 105), MNMF can cluster the decomposed bases into specific sources in the blind situation. As shown in the example of FIG. 1B, rank-1 MNMF may be used as a blind source separation method to obtain separated speech and interference channels. Rank-1MNMF separation can be implemented by signal separation unit 142 as shown in FIG. 1A. The first audio signal (e.g., the separated speech channel) has a higher speech signal ratio than the second audio signal (e.g., the separated interference channel). The second audio signal obtained from the signal separation may include few speech components or may not include any speech components.

Figure 3:
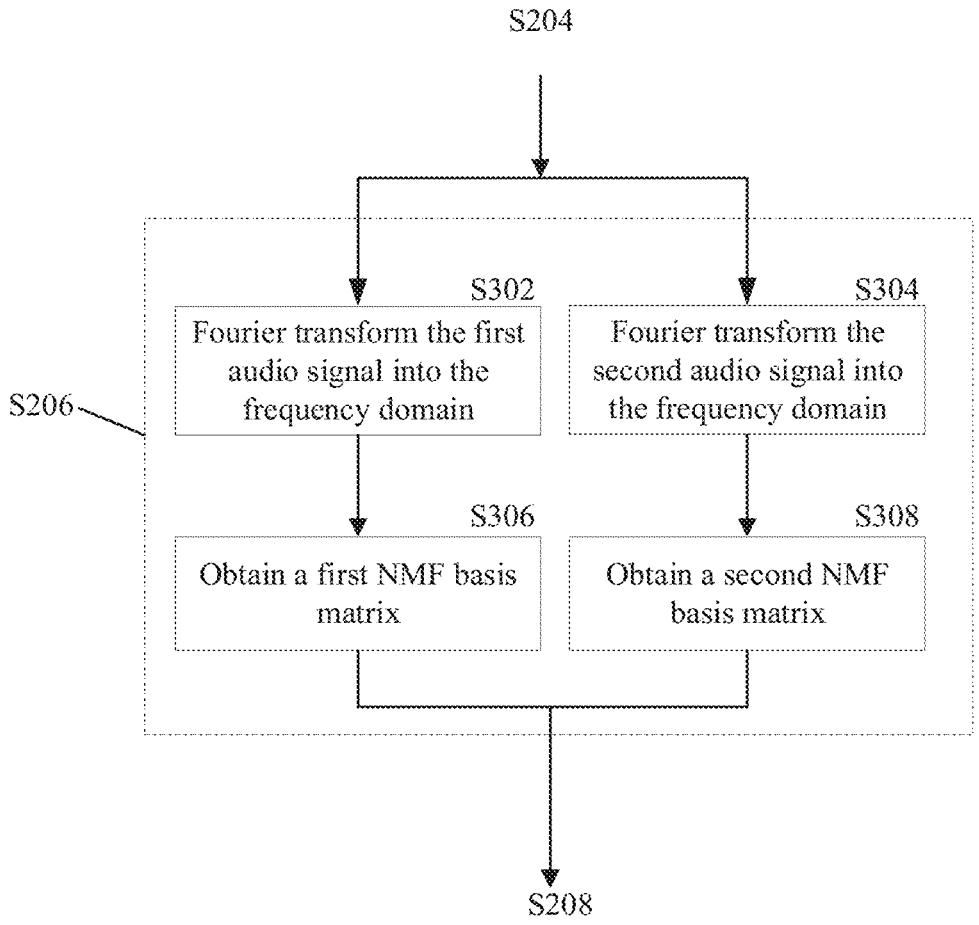
FIG. 3 illustrates a flowchart of an exemplary method for decomposing a first audio signal and a second audio signal in a frequency domain, according to embodiments of the disclosure.

Referring back to FIG. 2, in step S206, the first audio signal and the second audio signal are decomposed in a frequency domain. Processing details are shown in FIG. 3 from steps S302-S308. In step S302, the first audio signal can be Fourier transformed in the frequency domain. The transforming can be implemented in NMF decomposition unit 144 shown in FIG. 1A. In step S304, the second audio signal can be Fourier transformed in the frequency domain. In step S306, a first NMF basis matrix is extracted using NMF method based on the Fourier transformed first audio signal from step S302. Similarly, in step S308, a second NMF basis matrix is extracted using NMF method based on the Fourier transformed second audio signal generated from step S304.

If NMF decomposition unit 144 shown in FIG. 1A includes more than one processing units (e.g., different cores), step S302 and step 304 can be implemented in parallel as shown in FIG. 3. Alternatively, the signals can also be Fourier transformed in sequence. Similarly, step S306 and step 308 can be implemented in parallel or in sequence. In some embodiments, if the rank-1 MNMF is implemented to separate the speech channel and the noise channel as shown in module 150 of FIG. 1B, the basis matrices generated under MU rules in module 150 can be reused and steps S306-S308 can be skipped.

Figure 4:
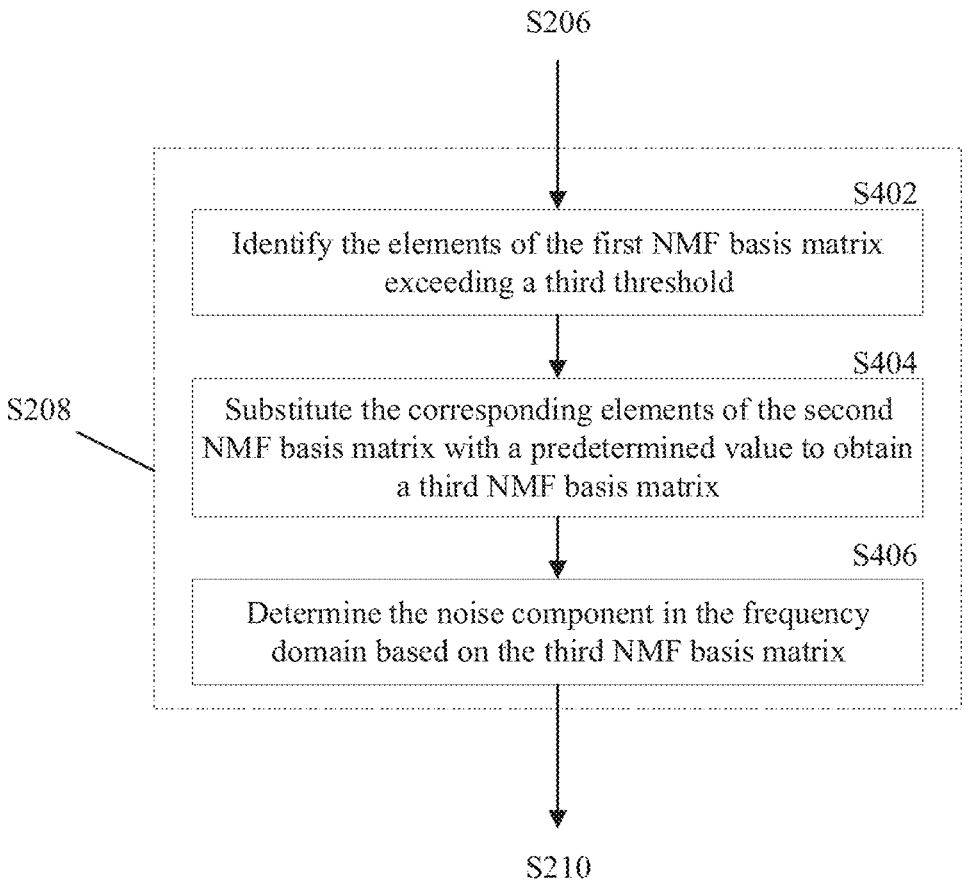
FIG. 4 illustrates a flowchart of an exemplary method for estimating a noise component of an audio signal in a frequency domain, according to embodiments of the disclosure.

Referring back to FIG. 2, in step S208, a noise component may be estimated based on a first NMF basis matrix and a second NMF basis matrix by noise estimation unit 146. Steps S402-S406 shown in FIG. 4 provides more details on how to estimate the noise component, as embodiments of step S208. In some embodiments, a third threshold is configured to identify elements of the first NMF basis matrix attributable to a speech signal. If an element value of the first NMF basis matrix is greater than or equal to the third threshold, the element is attributable to the speech component. If an element of the first NMF basis matrix is less than the third threshold, the element is not attributable to the speech component. For those attributable elements of the first NMF basis matrix, the corresponding elements of the second NMF basis matrix are substituted with a predetermined value. In some embodiments, the predetermined value is set to be 0. A modified second NMF basis matrix is saved as a third NMF basis matrix.

For example, a first NMF basis matrix $T_1$ and a second NMF basis matrix $T_2$ may be 3 by 3 matrices. Each row and column have three elements. For example, $T_1=[a_{11}\ a_{12}\ a_{13};\ a_{21}\ a_{22}\ a_{23};\ a_{31}\ a_{32}\ a_{33}]$. $T_2=[b_{11}\ b_{12}\ b_{13};\ b_{21}\ b_{22}\ b_{23};\ b_{31}\ b_{32}\ b_{33}]$. $a_{13}$ is the element of a first NMF basis matrix $T_1$ in the first row and the third column. $a_{22}$ is the element of the first NMF basis matrix $T_1$ in the second row and the second column. Values of $a_{13}$ and $a_{22}$ are less than a third threshold, and other elements of the first NMF basis matrix $T_1$ are greater than or equal to the third threshold. The predetermined value is set to 0. A third NMF basis matrix $T_3=[b_{11}\ b_{12}\ 0;\ b_{21}\ 0b_{23};\ b_{31}\ b_{32}\ b_{33}]$. In step S406 shown in FIG. 4, the noise component may be obtained by reconstructing the first NMF matrix using the third NMF basis matrix in the frequency domain.

In some special cases, the separated noise channel can include pure noise signals. It does not include any speech signals. In this case, the second NMF basis matrix is used as the third NMF basis matrix to estimate the noise component.

Figure 5:
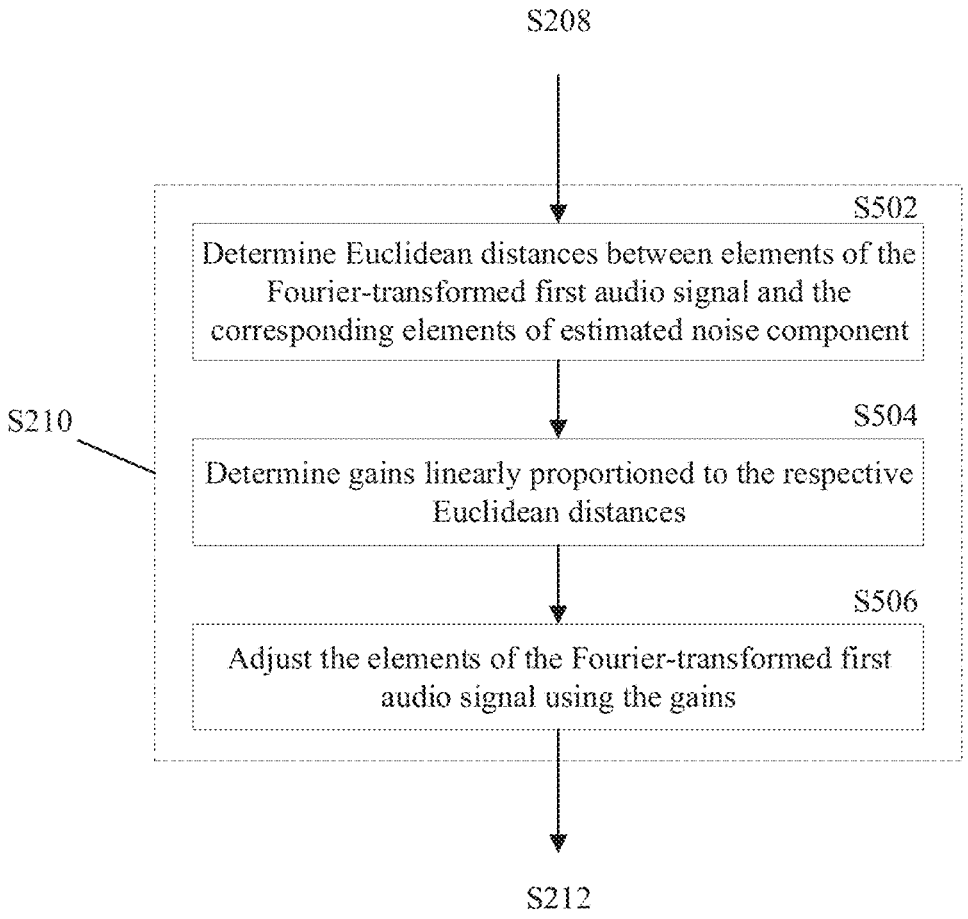
FIG. 5 illustrates a flowchart of an exemplary method for enhancing an audio signal based on an estimated noise component, according to embodiments of the disclosure.

Referring back to FIG. 2, in step S210, the first audio signal is enhanced based on the estimated noise component (e.g., the reconstructed speech spectrum) in the frequency domain. In some embodiments, speech signal enhancing unit 148 may be configured to enhance the first audio signal. Steps S502-S506 shown in FIG. 5 provide more details of embodiments implementing step S210. In step S502, Euclidean distances are calculated between elements of a Fourier-transformed first audio signal and the corresponding elements of an estimated noise component in the frequency domain. Euclidean distances indicate speech signal ratios in the Fourier-transformed first audio signal. In some embodiments, distance is calculated on each time-frequency (T-F) bin and then normalized along frequency scales. For example, $d_{i,j}=|X_1^{i,j}-X_3^{i,j}|$, $d_{i,j}=d_{i,j}/\|d_i\|$ where $X_1^{i,j}$ denotes the first audio signal at T-F bin (i,j), $X_3^{i,j}$ denotes an estimated noise component at T-F bin (i,j), $d_{i,j}$ represents the distance at T-F bin (i,j), and $\|\|$ is Euclidean norm.

Consistent with some embodiments, in step S504, gains are calculated based on Euclidean distances. In some embodiments, gains are linearly proportional to the respective Euclidean distances. For example, regularization can be used to obtain gains based on the Euclidean distances and the value of a gain is between 0 and 1. In some embodiments, a sigmoid-like activation function is used to convert the distance into the gain ranged in [0, 1].

In step S506, elements of the Fourier-transformed first audio signal generated in step 302 as shown in FIG. 3 are adjusted by gains. In some embodiments, a new element is a product of an element of the Fourier-transformed first audio signal and the corresponding gain.

Referring back to FIG. 2, in step S212, an enhanced speech signal may be obtained by inverse Fourier transforming an adjusted Fourier-transformed first audio signal from the frequency domain to the time domain. In some embodiments, speech signal enhancing unit 148 implements step S212 to inverse Fourier transform the adjusted Fourier-transformed first audio signal.

Another aspect of the disclosure is directed to a non-transitory computer-readable medium storing instructions which, when executed, cause one or more processors to perform the methods, as discussed above. The computer-readable medium may include volatile or non-volatile, magnetic, semiconductor, tape, optical, removable, non-removable, or other types of computer-readable medium or computer-readable storage devices. For example, the computer-readable medium may be the storage device or the memory module having the computer instructions stored thereon, as disclosed. In some embodiments, the computer-readable medium may be a disc or a flash drive having the computer instructions stored thereon.

It will be apparent to those skilled in the art that various modifications and variations can be made to the disclosed system and related methods. Other embodiments will be apparent to those skilled in the art from consideration of the specification and practice of the disclosed system and related methods.

It is intended that the specification and examples be considered as exemplary only, with a true scope being indicated by the following claims and their equivalents.

What is claimed is:

1. A computer-implemented audio signal processing method, the method comprising:

receiving, by a communication interface, multi-channel audio signals acquired from a common signal source;

separating the multi-channel audio signals into a first audio signal and a second audio signal in a time domain, wherein a first speech signal ratio of the first audio signal is higher than a first threshold and a second speech signal ratio of the second audio signal is lower than a second threshold, wherein the second threshold is smaller than the first threshold;

decomposing, by at least one processor, the first audio signal and the second audio signal in a frequency domain to obtain a first decomposition data and a second decomposition data, respectively;

estimating, by the at least one processor, a noise component in the frequency domain based on the first decomposition data and the second decomposition data; and enhancing, by the at least one processor, the first audio signal based on the estimated noise component.

2. The computer-implemented audio signal processing method of claim 1, wherein the multi-channel audio signals are separated into the first audio signal and the second audio signal using a Multi-channel Nonnegative Matrix Factorization (MNMF) method.

3. The computer-implemented audio signal processing method of claim 1, wherein decomposing the first audio signal and the second audio signal further comprises:

Fourier transforming the first audio signal and the second audio signal into the frequency domain; and decomposing the Fourier-transformed first audio signal and second audio signal using Nonnegative Matrix Factorization (NMF) to obtain a first NMF basis matrix and a second NMF basis matrix, respectively.

4. The computer-implemented audio signal processing method of claim 3, wherein estimating the noise component based on the first decomposition data and the second decomposition data further comprises:

obtaining a third NMF basis matrix by overwriting elements of the second NMF basis matrix that are corresponding to elements of the first NMF basis matrix attributable to a speech component; and determining the noise component in the frequency domain based on the third NMF basis matrix.

5. The computer-implemented audio signal processing method claim 4, wherein obtaining the third NMF basis matrix further comprises:

identifying the elements of the first NMF basis matrix exceeding a third threshold as attributable to the speech component; and substituting the corresponding elements of the second NMF basis matrix with a predetermined value.

6. The computer-implemented audio signal processing method claim 3, wherein enhancing the first audio signal based on the estimated noise component further comprises:

determining Euclidean distances between elements of the Fourier-transformed first audio signal and the corresponding elements of estimated noise component in the frequency domain; and adjusting the elements of the Fourier-transformed first audio signal by gains determined based on the respective Euclidean distances.

7. The computer-implemented audio signal processing method of claim 6, wherein the gains are linearly proportional to the respective Euclidean distances.

8. The computer-implemented audio signal processing method of claim 6, wherein enhancing the first audio signal based on the estimated noise component further comprises:

inverse Fourier transforming the adjusted Fourier-transformed first audio signal to obtain a speech signal in the time domain.

9. An audio signal processing system, comprising:

a communication interface configured to receive multi-channel audio signals acquired from a common signal source;

at least one processor, configured to:

separate the multi-channel audio signals into a first audio signal and a second audio signal originated in a time domain, wherein a first speech signal ratio of the first audio signal is higher than a first threshold and a second speech signal ratio of the second audio signal is lower than a second threshold, wherein the second threshold is smaller than the first threshold;

decompose the first audio signal and the second audio signal in a frequency domain to obtain a first decomposition data and a second decomposition data, respectively;

estimate a noise component in the frequency domain based on the first decomposition data and the second decomposition data; and enhance the first audio signal based on the estimated noise component; and a speaker configured to output the enhanced first audio signal.

10. The audio signal processing system of claim 9, wherein the multi-channel audio signals are separated into the first audio signal and the second audio signal using a Multi-channel Nonnegative Matrix Factorization (MNMF) method.

11. The audio signal processing system of claim 10, wherein the at least one processor is further configured to:

Fourier transform the first audio signal and the second audio signal into the frequency domain; and decompose the Fourier-transformed first audio signal and second audio signal using Nonnegative Matrix Factorization (NMF) to obtain a first NMF basis matrix and a second NMF basis matrix, respectively.

12. The audio signal processing system of claim 11, wherein the at least one processor is further configured to:

obtain a third NMF basis matrix by overwriting elements of the second NMF basis matrix that are corresponding to elements of the first NMF basis matrix attributable to a speech component; and determine the noise component in the frequency domain based on the third NMF basis matrix.

13. The audio signal processing system of claim 12, wherein the at least one processor is further configured to:

identify the elements of the first NMF basis matrix exceeding a third threshold as attributable to the speech component; and substitute the corresponding elements of the second NMF basis matrix with a predetermined value.

14. The audio signal processing system of claim 11, wherein the at least one processor is further configured to:

determine Euclidean distances between elements of the Fourier-transformed first audio signal and the corresponding elements of estimated noise component in the frequency domain; and adjust the elements of the Fourier-transformed first audio signal by gains determined based on the respective Euclidean distances.

15. The audio signal processing system of claim 14, wherein the gains are linearly proportional to the respective Euclidean distances.

16. A non-transitory computer-readable medium having stored thereon computer instructions, when executed by at least one processor, perform an audio signal processing method, the audio signal processing method comprises:

separating multi-channel audio signals acquired from a common signal source into a first audio signal and a second audio signal in a time domain, wherein a first speech signal ratio of the first audio signal is higher than a first threshold and a second speech signal ratio of the second audio signal is lower than a second threshold, wherein the second threshold is smaller than the first threshold;

decomposing the first audio signal and the second audio signal in a frequency domain to obtain a first decomposition data and a second decomposition data, respectively;

estimating a noise component in the frequency domain based on the first decomposition data and the second decomposition data; and enhancing the first audio signal based on the estimated noise component.

17. The non-transitory computer-readable medium of claim 16, wherein decomposing the first audio signal and the second audio signal further comprises:

Fourier transforming the first audio signal and the second audio signal into the frequency domain; and decomposing the Fourier-transformed first audio signal and second audio signal using Nonnegative Matrix Factorization (NMF) to obtain a first NMF basis matrix and a second NMF basis matrix, respectively.

18. The non-transitory computer-readable medium of claim 17, wherein estimating the noise component based on the first decomposition data and the second decomposition data further comprises:

obtaining a third NMF basis matrix by overwriting elements of the second NMF basis matrix that are corresponding to elements of the first NMF basis matrix attributable to a speech component; and determining the noise component in the frequency domain based on the third NMF basis matrix.

19. The audio signal processing system of claim 14, wherein the at least one processor is further configured to:

inverse Fourier transform the adjusted Fourier-transformed first audio signal to obtain a speech signal in the time domain.

20. The non-transitory computer-readable medium of claim 17, wherein enhancing the first audio signal based on the estimated noise component further comprises:

determining Euclidean distances between elements of the Fourier-transformed first audio signal and the corresponding elements of estimated noise component in the frequency domain; and adjusting the elements of the Fourier-transformed first audio signal by gains determined based on the respective Euclidean distances.

* * * * *